United States Patent [19]

Cantley

[11] 4,235,464

[45] Nov. 25, 1980

[54] DOOR LOCK CONSTRUCTION

[76] Inventor: Richard E. Cantley, 1469 Shelley St. NE., North Canton, Ohio 44720

[21] Appl. No.: 50,172

[22] Filed: Jun. 20, 1979

[51] Int. Cl.[3] ..... E05C 17/54

[52] U.S. Cl. ..... 292/288

[58] Field of Search ..... 292/288, 302, 343, 289, 292/292, 210

[56] References Cited

U.S. PATENT DOCUMENTS

| | | | |
|---|---|---|---|
| 673,783 | 5/1901 | Peters . | |
| 802,983 | 10/1905 | Gilbert . | |
| 1,119,650 | 12/1914 | Smith . | |
| 1,154,148 | 9/1915 | West . | |
| 2,205,614 | 6/1940 | Bashe . | |
| 2,425,937 | 8/1947 | Hilton . | |
| 2,537,049 | 1/1951 | Glatt | 292/145 |
| 2,555,611 | 6/1951 | Smith | 292/288 |
| 2,683,054 | 7/1954 | Earman . | |
| 2,988,787 | 6/1961 | Migneault et al. | 292/DIG. 46 |
| 3,773,369 | 11/1973 | Wersonick | 292/150 |
| 3,833,963 | 9/1974 | Waters | 16/82 |
| 3,930,678 | 1/1976 | Alexander | 292/288 |
| 3,977,714 | 8/1976 | Trotter | 292/343 |
| 4,161,333 | 7/1979 | Guttman | 292/150 X |

FOREIGN PATENT DOCUMENTS

| | | | |
|---|---|---|---|
| 893033 | 2/1972 | Canada | 292/289 |

*Primary Examiner*—Richard E. Moore

*Attorney, Agent, or Firm*—Frease & Bishop

[57] ABSTRACT

A portable door lock is removably mounted on the inside of an inwardly swinging door to prevent the opening of the door to provide added security for the inhabitants of a dwelling. The door lock includes a solid block of material, such as wood, and has a plurality of steel rods embedded therein and extending outwardly from an end surface of the block. The block has a flat planar surface extending downwardly toward the rods and forming an exterior angle of approximately 150° therebetween. A plurality of complementary-shaped holes are drilled in the door frame and extend inwardly and away from the door at a predetermined angle whereby the planar block surface lies in abutting relationship with the inside door surface when the rods are inserted into the holes to prevent opening of the door. Plastic sleeves are mounted in the outer exposed ends of the holes to provide an attractive appearance thereto.

11 Claims, 5 Drawing Figures

DOOR LOCK CONSTRUCTION

BACKGROUND OF THE INVENTION

1. Field of the Invention

The invention relates to a door lock construction, and in particular to a lock adapted to be manually installed on the inside of a protected door preventing unauthorized opening of the protected door. More particularly, the invention relates to a door lock having a plurality of rigid rods which are inserted into holes formed in the door frame and engageable with the swinging door edge to prevent opening of the same.

2. Description of the Prior Art

Numerous styles and types of door locks have been constructed using rigid locking bars or bolts to provide extra security, especially at night, for the residents of a dwelling. Most of these known constructions are permanently mounted on the door and door frame, which imparts a cluttered, unsightly appearance to the door since such a device is usually in addition to the existing door lock.

In most of these locking devices which use retaining bars or bolts, the bolt extends horizontally between the door and frame across the swinging edge of the door. Due to the limited material thickness of the door and door frame, such devices can be broken out if sufficient force is applied to the door. Also, these prior devices are difficult to install in that they require internal drilling of the door as well as of the frame for mounting, such as the usual "deadbolt" type of construction with the corresponding aligned holes being drilled in the frame and door edge. Also, the deadbolt mechanism and latch plate must be bolted or screwed on the door and frame.

It is desirable that some type of locking device be provided which is not a permanent part of the door or frame, which can be easily installed by the user when extra protection is required, such as at night, which is extremely difficult to forcibly break away from the door and door frame, which will not present an unsightly appearance when not in use, which is of a relatively inexpensive construction, and which can be installed with a minimum of labor and expense. My improved door lock construction which is described below and shown in the drawing is believed to satisfy these requirements and provide these advantages.

SUMMARY OF THE INVENTION

Objectives of the invention include providing an improved door lock construction which is not permanently attached to the door or frame so that it does not present an unsightly appearance when not in use, and which when installed provides an extremely strong device which would require a considerable amount of force to overcome its retaining effect; providing such a door lock which requires only several small holes to be drilled in the door frame for its use, and which holes cannot be readily seen by occupants of the dwelling or visitors thereto; providing such a door lock which is of an extremely simple, rugged and inexpensive design, in which a plurality of retaining pins or rods extend into and engage the door framing studs to provide increased strength than that provided by prior locking bolts or pins which engage only a portion of a single door frame stud or molding trim; providing such a door lock which is engaged or disengaged easily and quickly by inserting projecting rods into holes formed in the door frame in a single manipulative step, thereby enabling an occupant to unlock the door quickly in case of fire or other emergency; providing such a door lock which consists of a rigid block of material, such as wood, having a plurality of rigid steel locking rods embedded in the block and extending outwardly from one end thereof which are inserted into complementary-shaped and sized angled holes formed in the door frame, with the block having a flat planar surface which lies in abutting relationship with the inside surface of the door providing a retaining block locking arrangement between the door and frame; providing such a door lock which can be painted or stained to match the color of the door and frame with which it is to be used to make the lock less noticeable when in use; and providing an improved door lock construction which eliminates difficulties heretofore encountered, which achieves the stated objectives effectively, efficiently and inexpensively, and which solves problems and satisfies needs existing in the art.

These objectives and advantages are obtained by the improved door lock construction used in combination with an inwardly swinging door and adjacent door frame, the general nature of which may be stated as including a block of rigid material having a planar surface and a plurality of spaced rigid rods embedded in said block and projecting outwardly therefrom, with said rods lying in a common plane; the planar surface of the block sloping downwardly toward the rods and forming an exterior angle with the plane of the rods in the range of approximately 120° to 165°; and the planar surface of the block being adapted to abuttingly engage the inside surface of the door to prevent inward movement of said door when the rods are inserted into holes formed in the door frame and formed at an angle complementary to the angle of the rods with respect to the planar block surface.

BRIEF DESCRIPTION OF THE DRAWING

A preferred embodiment of the invention - illustrative of the best mode in which applicant has contemplated applying the principle - is set forth in the following description and shown in the drawing, and is particularly and distinctly pointed out and set forth in the appended claims.

Similar numerals refer to similar parts throughout the drawing.

DESCRIPTION OF THE PREFERRED EMBODIMENT

Figure 2:
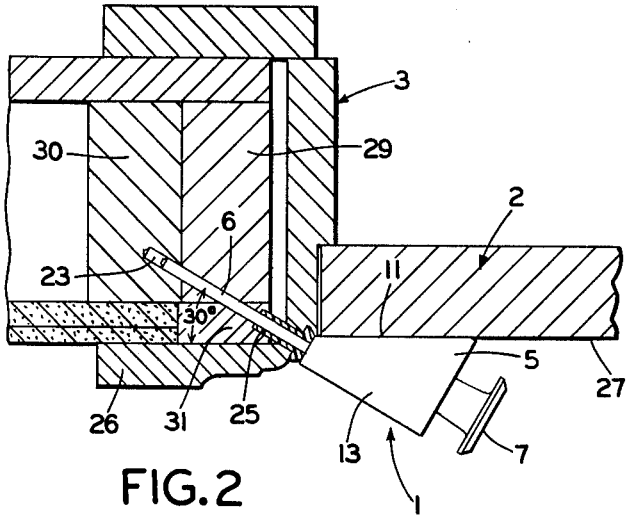
FIG. 2 is an enlarged sectional view taken on line 2—2, FIG. 1.
Figure 1:
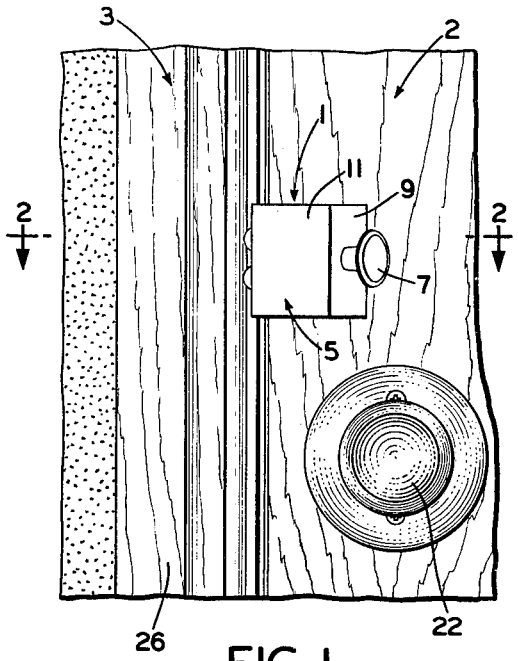
FIG. 1 is a fragmentary front view of the inside of a door and adjacent frame having the improved door lock mounted thereon.

The improved door lock construction is indicated generally at 1, and is shown mounted on and operatively engaged with a door 2 and a door frame 3 in FIGS. 1 and 2. Door lock 1 includes a block of rigid material, indicated generally at 5, preferably formed of a hard wood, and a pair of rods 6 and a handle 7.

Figure 3:
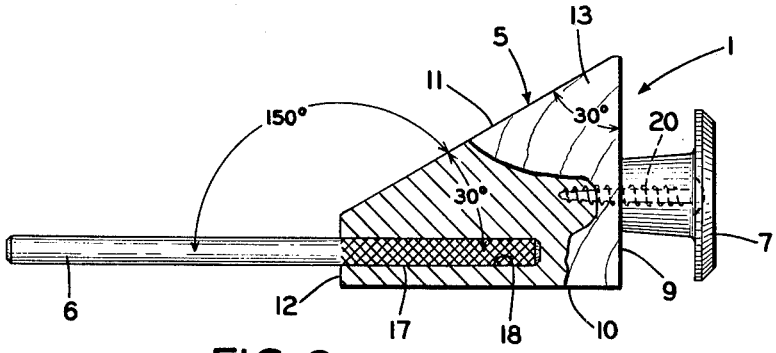
FIG. 3 is an elevational view of the improved door lock construction removed from the door, with portions broken away and in section.

Block 5 has a generally truncated configuration with a planar rear surface 9 which forms a right angle with a planar bottom surface 10, as shown in FIG. 3. A door-engaging planar top surface 11 extends downwardly forwardly from rear surface 9 at an angle of approximately 30° therewith, and terminates in a planar front surface 12. Front surface 12 is parallel with rear surface 9 and forms a right angle with bottom surface 10. A pair of spaced, generally triangularly shaped, parallel planar side surfaces 13 and 14 (FIG. 3), complete the surface configuration of block 5.

The terms "rear", "bottom", "top", "front" and "sides", when referring to the surfaces of block 5, are in relation to the position that block 5 is indicated in FIG. 3, and are for descriptive purposes only. When installed on a door, side surface 13 will assume a topmost position (FIG. 2) with the other surfaces being located accordingly.

Figure 4:
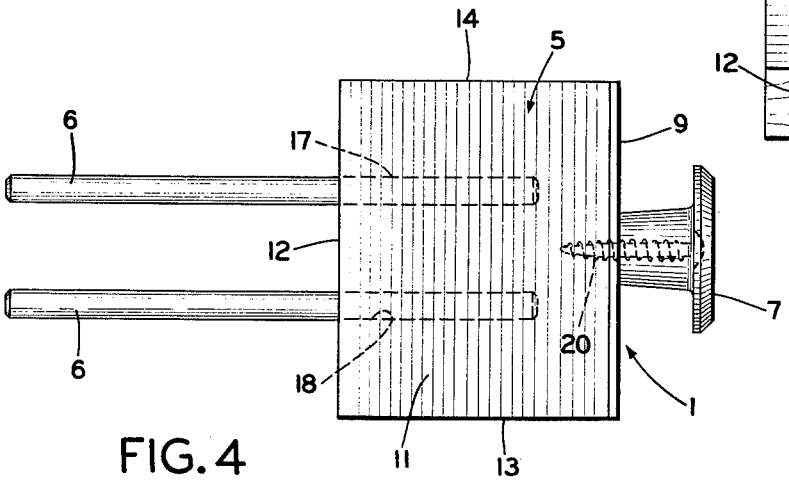
FIG. 4 is a top plan view of the door lock shown in FIG. 3.
Figure 5:
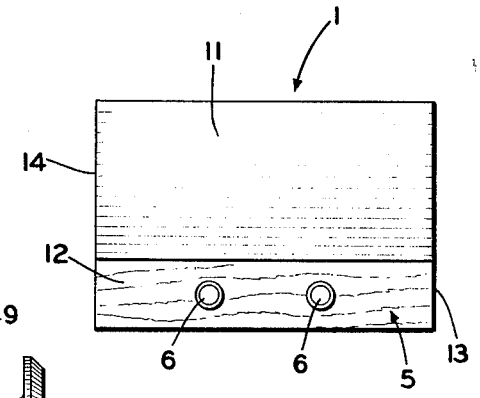
FIG. 5 is a left-hand end elevational view of the door lock shown in FIG. 4.

Rods 6 are formed of a hardened steel material and have a smooth cylindrical configuration with their inner ends 17 being knurled to form a tight force-fit engagement within complementary elongated holes 18 formed in block 5. Holes 18 extend inwardly from front surface 12 and parallel with bottom surface 10, and terminate before reaching rear surface 9. If desired, three or more rods 6 can be used by increasing the lateral length of block 5. Rods 6 are parallel with each other and lie in a common plane, as shown in FIGS. 3 and 4.

Handle 7 may be of any type of decorative configuration and is attached to block 5 on rear surface 9 by a screw 20 or other attachment means. Handle 7 merely provides a convenient and decorative means for installing and removing lock construction 1 from an installed position. If desired, handle 7 may be eliminated without affecting the concept of the invention.

An example of a preferred size of improved door lock 1 is as follows: The exposed ends of rods 6 each have a length of three inches, with the embedded ends being three inches in length. Rear surface 9 has a height of two inches and a transverse width of three inches. Bottom surface 10 has a length of two inches and a transverse width of three inches, and door-abutting surface 11 has a three-inch square configuration. These dimensions can be varied without affecting the concept of the invention.

In accordance with one of the features of the invention, rods 6 lie in an imaginary plane which forms an angle with the plane of door-abutting surface 11 in the range of approximately 120° to 165°, with the preferred angle being approximately 150°, as shown in FIG. 3.

The manner of use and installation of door lock 1 is shown diagrammatically in FIGS. 1 and 2. The preferred location of door lock 1 is just above the door handle or knob 22. A pair of vertically spaced holes 23 are drilled through the corner of door frame 3 adjacent the edge of the door frame at an angle complementary to the included angle of interception between door-abutting surface 11 and rods 6, which is approximately 30° in the preferred form, as shown in FIGS. 2 and 3. Holes 23 will be hardly noticeable in the door frame, being of a diameter of approximately ¼" to match the diameter of rods 6. A plastic insert sleeve 25 is inserted in the outer end of each hole 23 to prevent the raw edges of the hole from being exposed and subject to chipping or fraying. Preferably, insert sleeves 25 can be of a color which matches the color of molding trim 26, making the inserts unnoticeable. Likewise, block 5 may be painted or stained to match the color of the door and frame.

After door 2 has been shut, lock 1 is installed simply by inserting rods 6 in holes 23 until front surface 12 is abutting the outer ends of insert sleeves 25, at which position top surface 11 will be in abutting engagement against inside surface 27 of door 2. As can be seen in FIG. 2, the angular relationship of holes 23, which are dependent upon the angular relationship between rods 6 and top block surface 11, enables rods 6 to extend through the outermost stud 29 and partially into inner stud 30 of the door frame casing. This double stud arrangement is a common construction practice for most doorway casings.

As can be seen from FIG. 2, in order to open door 2, a sufficiently large force would have to be exerted inwardly on block 5 to completely move block 5 in a pivotal direction, requiring rods 6 to rip completely through portions of studs 29 and 30, molding trim 26, and any facing board 31, which may be installed therebetween. Door lock 1 is removed easily by merely pulling outwardly on handle 7, slidably disengaging rods 6 from within holes 23 and sleeves 25.

Accordingly, the improved door lock provides a construction which is extremely simplified and inexpensive, consisting only of a block of wood having a door-abutting planar surface angled at a predetermined angle with respect to the longitudinal axis of one or more reinforcing rods 6, which are embedded in the block and project a predetermined distance outwardly therefrom and, if desired, a decorative handle 7 may be attached to the block. Furthermore, only two angled holes having a relatively small diameter are required to be drilled in the door frame at a predetermined angle, the ends of which may receive plastic insert sleeves to provide a pleasing appearance. Likewise, no attachments of any type are necessary on the door itself which would leave holes or mar the surface thereof if later removed. Also, door-engaging surface 11 of block 5 could be covered with a protective cloth or felt material, if desired, to prevent any possible scratching or marring of the door surface.

If desired, block 5 may be formed of a high impact, high strength, plastic material, such as polystyrene or polycarbonate, with rods 6 being molded therein without affecting the concept of the invention.

Thus, door lock 1 provides an efficient device which achieves all the enumerated objectives, eliminates difficulties encountered with prior door locking devices, and solves problems and obtains new results in the art.

In the foregoing description, certain terms have been used for brevity, clearness and understanding, but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved door lock construction is constructed, assembled and operated, the characteristics of the new construction, and the advantageous, new and useful results obtained; the new and useful structures, devices, elements, arrangements, parts and combinations are set forth in the appended claims.

I claim:

1. In combination with an inwardly swinging door and adjacent door frame, an improved door lock construction including:

(a) a block of rigid material having a surface adapted to abuttingly engage the inside surface of the door;

(b) rigid rod means mounted on the block and projecting outwardly therefrom, said rod means forming an exterior angle with the door-engaging surface of the block in the range of approximately 120° to 165°; and (c) hole means formed in the door frame, said hole means having a size and configuration complementary to the size and configuration of the rod means for receiving the same, and said hole means projecting inwardly and away from the adjacent door at an angle with respect to the inside door surface, whereby the door-engaging surface of the block lies in abutting relationship with the door surface when the door is closed and the rod means is inserted into the door frame hole means preventing opening of the door.

2. The door lock construction defined in claim 1 in which the block has a generally truncated configuration defined by a pair of spaced parallel side surfaces, a bottom surface, and front and rear end surfaces; and in which the door-engaging surface is a flat planar surface extending downwardly from the rear surface toward the front surface.

3. The door lock construction defined in claim 1 in which the block is formed of wood and has a generally truncated configuration; in which the rod means is a plurality of rigid metalic rods embedded in the block and projecting outwardly therefrom; and in which the door-engaging surface is a flat planar surface angled downwardly toward the rods.

4. The door lock construction defined in claim 3 in which the hole means is a plurality of vertically spaced holes having a spacing complementary to the spacing of the rods; and in which plastic sleeves are inserted in the outer portion of the holes.

5. The door lock construction defined in claim 3 in which the rods extend outwardly from the block approximately three inches.

6. The door lock construction defined in claim 1 in which handle means is mounted on the block to facilitate the insertion and removal of the rod means into and out of the hole means.

7. The door lock construction defined in claim 1 in which the rod means includes a plurality of rods which lie in a first imaginary plane; in which said door-engaging block surface lies in a second imaginary plane; and in which said first and second planes form an exterior angle of approximately 150°.

8. An improved door lock construction adapted to be mounted on the inside of an inwardly swinging door adjacent the frame thereof, in which frame a plurality of inwardly extending holes have been formed; said lock construction including a block of rigid material having a door-engaging planar surface and a plurality of spaced rigid rods embedded in said block and projecting outwardly therefrom with said rods lying in a common imaginary plane; the planar surface of the block sloping downwardly toward the rods and forming an exterior angle with the plane of the rods in the range of approximately 120° to 165°; and the planar surface of the block being adapted to abuttingly engage the inside surface of the door to prevent inward movement of said door when the rods are inserted into the holes of the door frame.

9. The lock construction defined in claim 8 in which the block is formed of wood; in which a plurality of holes are formed in the block; in which the rods are formed with knurled ends; and in which the knurled rod ends are inserted into the block holes to embed said rods in said block.

10. The lock construction defined in claim 8 in which a handle is mounted on the block opposite of the rods.

11. The lock construction defined in claim 8 in which the block of rigid material is formed of a high strength plastic material.

* * * * *